US005765742A

United States Patent [19]

Marks

[11] Patent Number: 5,765,742

[45] Date of Patent: Jun. 16, 1998

[54] LIGHT DUTY, FORWARD ACTING STAPLING MACHINE

[76] Inventor: Joel Steven Marks, 10508 Wilkins Ave., Los Angeles, Calif. 90024

[21] Appl. No.: 694,815

[22] Filed: Aug. 9, 1996

[51] Int. Cl.[6] ..... B25C 5/06

[52] U.S. Cl. ..... 227/132; 227/120

[58] Field of Search ..... 227/120, 132, 227/134, 128

[56] References Cited

U.S. PATENT DOCUMENTS

| | | | |
|---|---|---|---|
| 2,326,540 | 8/1943 | Krantz . | |
| 2,769,174 | 11/1956 | Libert | 1/49 |
| 2,795,786 | 6/1957 | Forrester | 227/120 |
| 3,305,156 | 2/1967 | Khan | 227/120 |
| 3,862,712 | 1/1975 | LaPointe et al. | 227/127 |
| 4,119,258 | 10/1978 | Ewig, Jr. | 227/132 |
| 4,150,774 | 4/1979 | Wright | 227/132 |
| 4,717,062 | 1/1988 | Ebihara | 227/120 |
| 5,407,118 | 4/1995 | Marks | 227/132 |
| 5,588,577 | 12/1996 | Chen | 227/120 |

FOREIGN PATENT DOCUMENTS

| | | |
|---|---|---|
| 0 281 541 B1 | 5/1991 | European Pat. Off. . |
| 807937 | 1/1959 | United Kingdom . |

*Primary Examiner*—Scott A. Smith

*Attorney, Agent, or Firm*—Paul Y. Feng; Fulwider Patton Lee & Utecht, LLP

[57] ABSTRACT

A simplified fastening tool which uses the energy stored in a spring to install fasteners by an impact blow is disclosed. A housing body is preferably cast or molded. A one-piece plastic hand lever is pivotably attached to the body where the pivoting action is by sliding in a circular arcuate channel. A staple feeding track is slidably mounted to the bottom of the housing and includes a rear end element with forwardly extending resilient latching elements to secure the track. A hand grip opening extends forward up to the plunger and the hand lever is hinged at the rear of the housing.

9 Claims, 4 Drawing Sheets

LIGHT DUTY, FORWARD ACTING STAPLING MACHINE

BACKGROUND OF THE INVENTION

1. Field of the Invention

The present invention generally relates to manually powered fastening devices and specifically to impact driven staple guns and tacking machines.

2. Description of the Related Art

The fastening tool of the invention may use an operating principle similar to that disclosed in several U.S. patents, including U.S. Pat. No. 5,407,118 to Marks. In Marks, an operating handle is hinged at a rear end of the tool housing while a staple is ejected from the bottom front end. A staple feeding track slides rearward from the bottom of the tool body to expose a staple holding chamber. A releasable latch retains the track from sliding rearward.

U.S. Pat. No. 2,326,540 issued to Krantz discloses a staple gun in which a hand lever is pivoted at the back and an actuating lever is pivoted above the hand grip opening with a lifting end engaging the rear portion of a large plunger lifting assembly.

U.S. Pat. No. 2,769,174 issued to Libert discloses a staple gun in which a hand lever is pivoted at the back and an actuating lever is pivoted in front of the hand grip opening with a lifting end still further forward of the hand grip opening.

U.K. Patent Specification No. 807 937 issued to Seimsen and Post discloses a staple gun in which a hand lever is pivoted at the rear end and an actuating wheel is located in front of the hand grip opening with lifting ends engaging a plunger in front of the wheel.

U.S. Pat. No. 3,862,712 issued to LaPointe et al. discloses a staple gun with a staple feeding track that slides rearward to expose a staple loading chamber. A releasable latch assembly retains the track in position.

U.S. Pat. No. 4,119,258 issued to Ewig Jr. discloses a staple gun with a body and hand lever constructed substantially of plastic material.

U.S. Pat. No. 4,150,774 issued to Wright discloses a staple gun with a staple feeding track including a rearwardly cantilevered flexible latch.

European Patent Published Specification No. 0 281 541 B1, filed by B. Westerland discloses a staple gun with a hand lever pivoted near the front, a flat plunger, and a spring elongated rearward from the front.

SUMMARY OF THE INVENTION

In a preferred embodiment, the present invention comprises a forward acting stapling device wherein the hand lever is hinged at the rear. However, most of the improvements of the present invention are equally useful when incorporated into a rearward acting stapling device wherein the hand lever is hinged toward the front of the tool.

In the preferred embodiment, an all plastic hand lever is pivotably attached to an optional, all plastic housing body. A circular arced extension from the end of the hand lever slidably engages a circular slot formed by walls of the housing body. The arced extension pivots around a post forming the top of the slot and slides atop a curved wall forming the bottom of the slot. This design provides a fully supported pivot for the hand lever through the required pivoting motion without the need for a hole passing through the hand lever. One advantage of this hinge concept is that the pivot point can be immediately adjacent to the housing edgewall allowing the longest practical handle within the confines of the tool body. If a hole is used through the handle, a wall of the handle fully surrounds the post so the post would need to be spaced farther inward from the edgewall to make room for the wall surrounding the hole.

Another advantage is that the pivot slot can be formed entirely from the material of a plastic housing while retaining substantial strength. The post and curved wall are extensions of the housing edgewall and get additional support from the edgewall as a result. In contrast, an isolated post through a hole in the handle would have only the housing sidewall for support.

A further substantial advantage of the present invention pivot slot design is that, in a preferred embodiment, the all plastic handle can be injection molded with the arced extension in a simple two-piece mold. A pivot hole requires a cross acting slide bar in the mold which complicates the manufacture of both the mold and the hand lever.

A staple feeding track is slidably mounted at the bottom of the housing body of the invention. A latching component features forward extending resilient arms which releasably latch to a rib of the housing body. The distal ends of the arms are biased to press outward against the internal sides of the housing body. To disengage the arms from the housing they are squeezed toward each other by pressing an exposed surface near the base of each arm, thus allowing the track to slide out. Sliding the track back into position under the housing causes the arms to snap into engagement with the housing.

U.S. Pat. No. 4,150,774 to Wright shows a rearward extending latching means typical of the prior related art. Extension 33 of Wright is pressed to disengage a slidable element from the staple feeding chamber. Such a design is lengthwise inefficient since the extension must extend farther rearward from a portion of the staple chamber that is usable for staple storage and feeding. Extension 33 is pressed at its distal end while the latching occurs closer to the base. A relatively large pressing motion is therefore needed to disengage the latch. The area near extension 33 must be kept clear to allow this large motion.

In contrast, the latching arm of the present invention is cantilevered forward from the rear of the track. The arm is pressed between the base and the distal end. A relatively small motion at the pressing point produces a relatively large motion at the latching point. The overall motion of the latch remains limited so the latching elements can be coextensive with useable track length. The latches do not interfere, for example, with a spring biased staple pusher assembly or stored staples.

In this manner, an efficient staple storage and feeding assembly is obtained using a track of minimal length. In the preferred embodiment of the invention the rear end of the track is tucked under the tool body forming a smooth exterior rear surface. This smooth surface is possible since the improved design of the invention has the latches oriented forward into the tool body.

In the preferred embodiment of the invention, the hand lever is pivoted at a rear and uppermost practical location of the tool body using the pivot mechanism described above. An actuating lever links the hand lever to a plunger. The plunger is a substantially flat sheet metal form within a narrow vertical channel of the tool housing.

A hand grip opening extends to a front end just beyond the plunger.

The forwardly gripped, forwardly acting design of the preferred embodiment provides the advantage that the hand lever is pressed and the tool is griped from a position substantially directly above the staple exit location. The staple can be pressed in with an action similar to that of a desk top stapler.

DETAILED DESCRIPTION OF THE INVENTION

In the following description, numerous details such as specific materials and configurations are set forth in order to provide a more complete understanding of the present invention. But it is understood by those skilled in the art that the present invention can be practiced without those specific details. In other instances, well-known elements are not described explicitly so as not to obscure the present invention.

Figure 1:
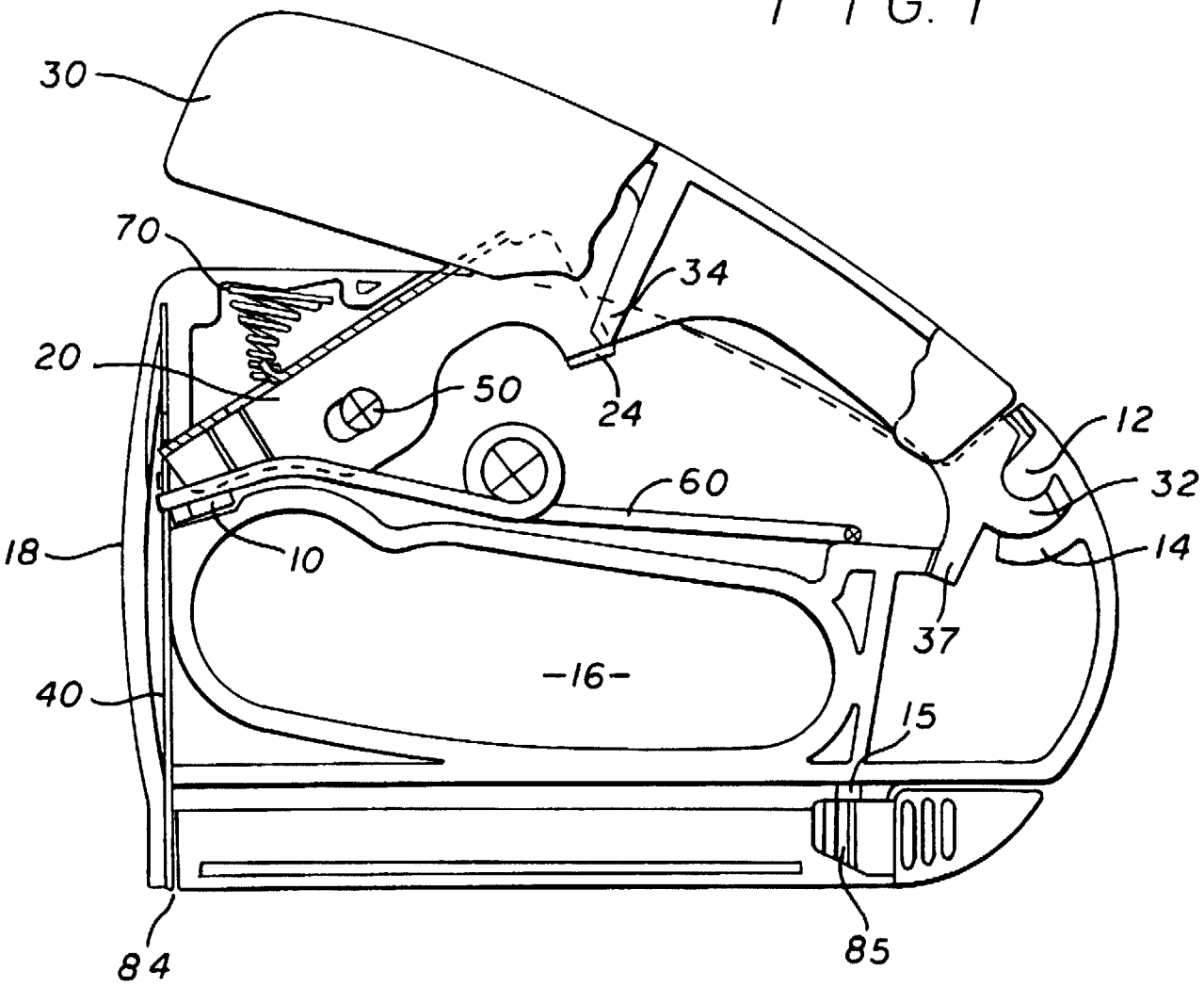
FIG. 1 is a side elevational view of a preferred embodiment staple gun, shown in a partial sectional view, of the present invention in an initial configuration.
Figure 3:
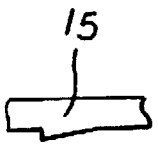
FIG. 3 is a sectional view of a staple gun housing showing a latching element.

FIG. 1 shows all the essential elements of the present invention. Housing body 18 is shown with one half removed to expose the internal components. Staple exit chamber 84 is the lower portion of a thin vertical channel within housing 18. Plunger 40 is vertically movable within the vertical channel.

Figure 7:
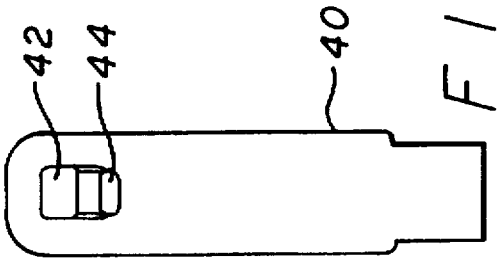
FIG. 7 is a rear elevational view of the plunger of FIG. 6.

Power spring 60 provides a downward bias upon plunger 40 while the downward motion of the spring and plunger assembly is limited by shock absorber 10. Actuating lever 20 is slidably, pivotably mounted to pin 50. Lever 20 and spring 60 engage plunger 40 at slots 42 and 44 respectively, as best seen in FIG. 7.

Hand lever 30 is pivotably mounted to housing 18 below pivot 12 and above rib 14. In a preferred embodiment, this pivot location is at the rear of housing 18, but in an alternative embodiment (not shown), hand lever 30 may be pivoted at the front of housing 18. Return spring 70 provides a reset bias to actuating lever 20 and hand lever 20.

Rib 34 of hand lever 30 slidably and pivotably engages tab 24 of actuating lever 20. Extension 37 of hand lever 30 is a stop to limit travel of hand lever 30.

Figure 2:
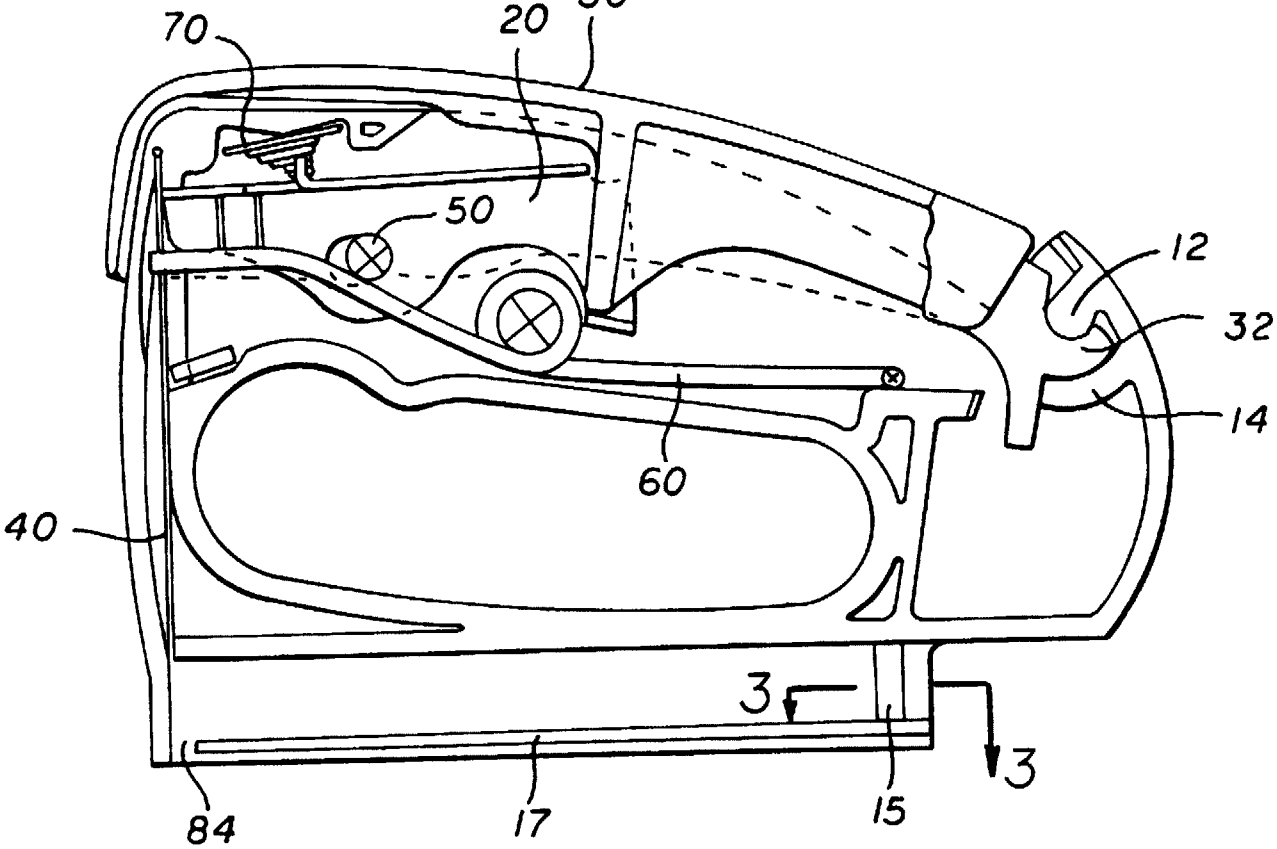
FIG. 2 is another side elevational view of the staple gun of FIG. 1, just prior to ejection of a staple.
Figure 5:
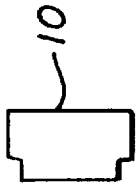
FIG. 5 is a plan view of a shock absorber element.
Figure 8:
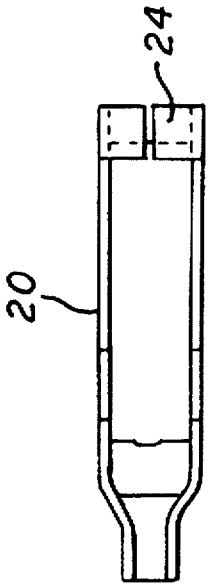
FIG. 8 is a bottom plan view of an actuating lever.

As hand lever 30 is pressed down, actuating lever 20 lifts plunger 40 to the position shown in FIG. 2. As a result of the arcing motion about pin 50, lever 20 disengages plunger 40. The plunger 40 and power spring 60 assembly instantly moves downward to eject a staple from staple exit chamber 84. Return spring 70 exerts a downward and forward bias on actuating lever 20 in FIG. 1 so that actuating lever 20 re-engages slot 42 of plunger 40.

The locations of pivot 12, tab 24 and pin 50 are aligned at an intermediate rotational position of hand lever 30. At this condition there is no sliding between rib 34 and tab 24. There is sliding when tab 24 is above and below this point, but the sliding is minimized when tab 24 stays as close as possible to the aligned condition. It is therefore not essential that a roller linkage be used to reduce friction between hand lever 30 and lever 20 at tab 24.

Figure 4:
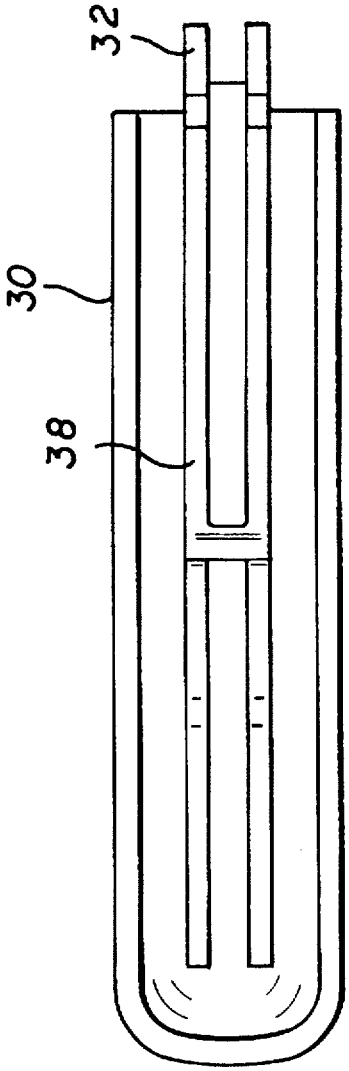
FIG. 4 is a bottom plan view of a staple gun hand lever.

Hand lever 30 has circular, arced extensions 32 as seen in FIGS. 1 and 4. These segments are extensions of stiffening ribs 38 within hand lever 30. Since ribs 38 engage pivot 12 directly through extensions 32, hand lever 30 is pivoted most rigidly to housing 18.

Figure 6:
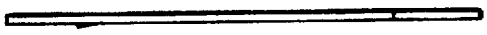
FIG. 6 is a side elevational view of a plunger.
Figure 9:
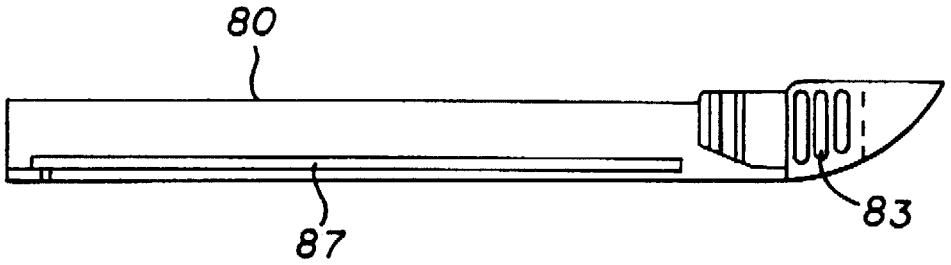
FIG. 9 is a side elevational view of a staple feeding track and latching assembly.
Figure 10:
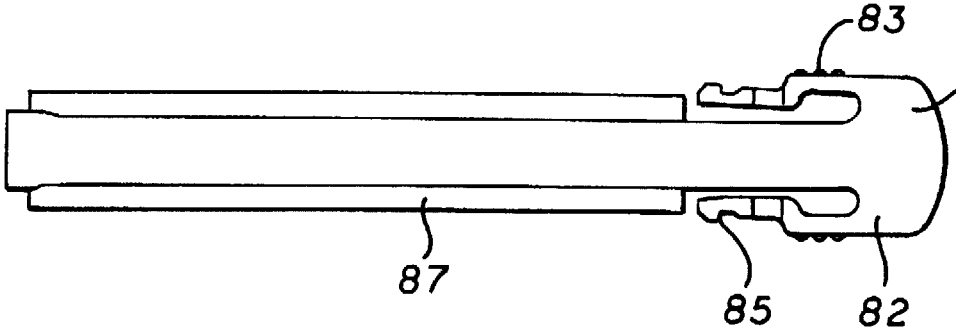
FIG. 10 is a bottom plan view of the assembly of FIG. 9.

Plunger 40 is preferably a thin sheet metal form that is substantially flat except for small out-of-plane features which may be incorporated as a design choice. For example, between slots 42 and 44, an out-of-place web is visible (FIGS. 6 and 7) to provide clearance for the front end of lever 20. A completely flat plunger 40 may also be used.

Lever 20 directly engages flat plunger 40 at a location substantially directly above hand grip opening 16. The hand grip opening extends forward to immediately adjacent to plunger 40.

Feeding track 80 has a spring biased pusher (not shown), which biases staples forward upon track 80 in a conventional way. End 81 has attached latching arms 82 which further have detent latches 85 at a forward distal end. End 81 may be integral with, or alternately separately attached to, track 80. Track 80 has flanges 87 to slidably engage channels 17 of housing 18.

To expose a staple holding chamber within housing 18, track 80 slides rearward from under housing 18. To disengage latch 85 from detent rib 15, ribbed surfaces 83 of resilient latch arms 82 are pressed inward. Track 80 is then free to slide rearward. Sliding track 80 forward in position under housing 18 causes ramps of rib 15 and latch 85 to deflect and allow re-engagement of latch 85 against rib 15.

When track 80 is closed, end 81 forms, in a preferred embodiment, a smooth surface at the rear to blend and match the rear end of housing 18. This is possible because the latching elements are hidden within the staple holding chamber of housing 18. Further, this design is desirable in the preferred embodiment forward acting design to enhance the appearance that end 81 is a rear end.

However, the improvements of the invention comprising the hand lever pivot and the track latch are also beneficial to a conventional rearward acting staple gun when a smooth, compact and low cost design are desired.

What is claimed is:

1. A fastening device comprising:

a housing body to support and guide functional components;

a fastener guide track attached to the housing within a fastener chamber at a bottom of the housing to guide fasteners toward a front of the housing;

the fastener guide track slidable within the fastener chamber between a first position below the housing and a second position rearward of the first position;

a track end structure at a rear of the fastener guide track including a rear distal end of a track assembly;

at least two latching arms, each extending forward from a base at the track end structure including at a forward distal end a detent contour element, each latching arm being resiliently flexible, and wherein each latching arm is biased away from the interior of the fastener chamber; and at least two detent contours of the housing each engaging the detent contour element of the respective latching arm when the fastener guide track is in the first position, the track assembly thus secured in the first position.

2. The fastening device of claim 1, wherein each latching arm has an intermediate portion between the base and the forward distal end, a surface of the intermediate portion is exposed externally from the housing body, and wherein the distal end is located within the fastener chamber in the first position, whereby pressing the surface of the intermediate portion causes the latching arm to deflect and the latching arm detent element to move out from engagement with the housing detent contour.

3. The fastening device of claim 2, wherein the two latching arms are substantially identical and opposed on opposite sides of the fastening device and the latching arms are pressed toward each other when pressing the surface of each latching arm.

4. A fastening device comprising:

a housing body to support and guide functional components including a top, a bottom, opposing sides, a front, and a back;

a fastener guide track attached to the housing within a fastener chamber at the bottom of the housing to guide fasteners toward the front of the housing;

notches formed in the fastener chamber;

the fastener guide track slidable within the fastener chamber between a first position below the housing and a second position rearward of the first position;

a track end structure at a rear of the fastener guide track having a rear distal end of a track assembly;

two latching arms attached by arm bases to the track end structure, the arms extending forward to a distal end opposed from each other on each side of the track end structure including at each forward arm distal end a detent contour element, the latching arms resiliently flexible toward each other and substantially identical to each other;

each latching arm having an intermediate portion between the arm base and the arm distal end, wherein a surface of the intermediate portion is exposed externally on each side of, and rearward of, the housing body, the surface of the intermediate portion having a pressing surface;

the arm distal ends being within the fastener chamber in said first position such that pressing the pressing surfaces toward each other causes the arm distal ends to deflect toward each other and the detent contour elements to disengage notches in the fastener chamber; and wherein pressing the pressing surfaces toward each other and pulling the pressing surfaces rearward causing the guide track to slide rearward.

5. The fastening device according to claim 4, wherein the track end structure and the latching arms are a single, integral molded element.

6. An elongated magazine for storing a plurality of fasteners packed in alignment, the magazine being in a first position within an elongated chamber of a fastening device, the magazine sliding to a second position wherein the magazine extends outward from the chamber, a latching means to releasably hold the magazine in the first position, the magazine comprising:

a molded structure attached to a rear end of the magazine, surrounding the rear of the magazine, portions of the molded structure extending toward a front of the magazine along opposing external sides of the magazine;

the molded structure conforming smoothly with an external shape of the fastening device;

the portions of the molded structure extending frontward including latching arms, wherein the latching arms are cantilevered from a rear base to a front distal end;

the latching arms spaced from the sides of the magazine wherein pressing the latching arms toward the magazine and toward each other causes the latching arms to resiliently deflect;

the latching arms each including a latching detent at the front distal end, the latching detent engaging a further detent within the elongated chamber of the fastening device when the magazine is in the first position;

the arms each including a pressing surface between the arm rear base and the arm distal end, the pressing surfaces facing oppositely away from each other and rearward of the elongated chamber;

wherein deflecting the latching arms by pressing the pressing surfaces toward each other causes the latching detents to disengage the further detents so that the arms are deflected toward each other, and the magazine is free to slide rearward by pulling the pressing surfaces rearward.

7. The magazine according to claim 6, wherein the latching detents and the further detents each include elongated ribs, and the ribs are oriented in a vertical alignment, perpendicular to a length of the elongated chamber.

8. The magazine according to claim 7, wherein the elongated ribs of the further detent protrude inward from inner sidewalls of the chamber, each rib including a forward and a rear face, each forward face oriented substantially perpendicular to the inner sidewall to form a detent surface of the further detent, each rear face angled from the inner sidewall to form a ramp surface.

9. The magazine according to claim 7, wherein the elongated ribs of the latching detents protrude outward in opposite sideways directions, each rib including a forward face and a rear face, each rear face oriented substantially perpendicular to the inner sidewall to form a detent surface of the latching detent, each forward face angled from the inner sidewall to form a ramp surface.

* * * * *